US010652666B1

(12) United States Patent
Mayo et al.

(10) Patent No.: US 10,652,666 B1
(45) Date of Patent: May 12, 2020

(54) LIQUID FILLED THERMOACOUSTIC DEVICE

(71) Applicant: The United States of America as represented by the Secretary of the Navy, Newport, RI (US)

(72) Inventors: Nathanael K Mayo, Bristol, RI (US); John B Blottman, North Andover, MA (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 16/137,668

(22) Filed: Sep. 21, 2018

(51) Int. Cl.
*H04R 23/00* (2006.01)
*H04R 1/02* (2006.01)
*H04R 1/06* (2006.01)

(52) U.S. Cl.
CPC ..... *H04R 23/002* (2013.01); *H04R 1/025* (2013.01); *H04R 1/06* (2013.01)

(58) Field of Classification Search
CPC ... H04R 23/002; H04R 1/025; Y10S 977/751; G10K 15/04; G10K 15/02; G01H 3/00
See application file for complete search history.

(56) References Cited

U.S. PATENT DOCUMENTS 8,259,968 B2 9/2012 Jiang et al.
9,635,468 B2 4/2017 Aliev et al.
2010/0054504 A1* 3/2010 Jiang ..... G10K 15/04 381/164
2016/0037267 A1* 2/2016 Aliev ..... H04R 23/002 381/164
2016/0187980 A1* 6/2016 Ray ..... G06F 3/04886 345/173

FOREIGN PATENT DOCUMENTS

WO WO-2013010398 A1 * 1/2013 ..... H04R 23/002

OTHER PUBLICATIONS

Luo, Photoacoustic and Thermoacoutic Imaging Application in Biomedical, Sep. 1, 2008, World Scientific Publishing Co Pte Ltd, pp. 27-30. (Year: 2008).*

* cited by examiner

*Primary Examiner* — Fan S Tsang
*Assistant Examiner* — Angelica M McKinney
(74) *Attorney, Agent, or Firm* — James M. Kasischke; Michael P. Stanley

(57) ABSTRACT

A thermoacoustic device is provided with a housing having at least one open face. An active element is supported within the housing, and at least two electrodes are provided in electrical contact with the active element. A membrane is provided to cover each open face of the housing. The housing and membrane assembly is filled with a liquid. A signal lead is joined to the electrodes within the housing to communicate with the exterior of the housing. The active element can be made from a carbon nanotube sheet, and a gas can be provided in contact with the active element.

20 Claims, 2 Drawing Sheets

LIQUID FILLED THERMOACOUSTIC DEVICE

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention is directed to a thermophone and more particularly to an encapsulated thermophone for use in underwater systems.

(2) Description of the Prior Art

Thermophones are devices which generate sound using heat which is supplied to an active element or filament via an alternating electric current. By Joule heating an active element, which has a low heat capacity, thermal rarefaction and contraction occurs within a small volume of gas immediately surrounding the filament producing a pressure wave. Thermophones have not been able to keep up with the much higher efficiencies of conventional acoustic sources such as electrodynamic loudspeakers and piezoelectric ceramics.

Carbon nanotube (CNT) structures were first described as a crystal structure in 1991. These are tiny fibrils of carbon roughly between 1 nm and 100 nm in diameter with individual lengths of up to centimeters. Many applications have been found for these structures. A group from the University of Texas at Dallas (UTD) created a method for producing CNT vertical arrays which can be spun into fibers or drawn out horizontally into thin sheets. These fibers and sheets have many applications.

Using CNT sheets has been explored for underwater thermophones. U.S. Pat. No. 8,259,968 shows use of carbon nanotubes sheets as a thermophone active element. These sheets are submerged in a liquid environment and are joined to a support structure. The support structure provides support for the carbon nanotube sheets in a planar, curved, or other three-dimensionally shaped form.

U.S. Pat. No. 9,635,468 also submerged CNT sheets underwater for thermoacoustic sound generation. In order to avoid damaging the CNT sheets, these sheets were encapsulated. In these encapsulated devices, a significant amount of effort is made to limit contact between the CNT sheet and the encapsulation media. In most cases, the carbon nanotube sheet is suspended between two plates or membranes so as not to make contact and leak thermal energy (heat). It is also known to use a support material to improve robustness of the CNT sheet.

Tests on CNT thermophones in air have shown a linear dependence of acoustic pressure on frequency and power. It has also been demonstrated that encapsulated thermophones exhibit resonant behavior which is determined largely by the properties of the encapsulation media. Utilizing thinner, lightweight membranes allows for broader resonances which behave more like an open system, while thicker, heavier plates create a more highly resonant system. Submerging these encapsulated devices causes their resonance frequencies to shift, primarily due to mass loading on the surface of the encapsulation media. An unintended consequence of submerging these gas filled encapsulated structures is that the extra pressure at depth will cause the encapsulation media to bow inward. To remedy this, an often complicated pressure compensation system must be attached and accompany the thermophone.

It is thus desirable to provide a thermophone that is pressure tolerant and can be used in an underwater environment.

SUMMARY OF THE INVENTION

It is a first object to provide an underwater sound source.

Another object is to an efficient underwater sound source that is pressure tolerant.

Accordingly, there is provided a thermoacoustic device with a housing having at least one open face. An active element is supported within the housing, and at least two electrodes are provided in electrical contact with the active element. A membrane is provided to cover each open face of the housing. The housing and membrane assembly is filled with a liquid. A signal lead is joined to the electrodes within the housing to communicate with the exterior of the housing. The active element can be made from a carbon nanotube sheet, and a gas can be provided in contact with the active element.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

Figure 1:
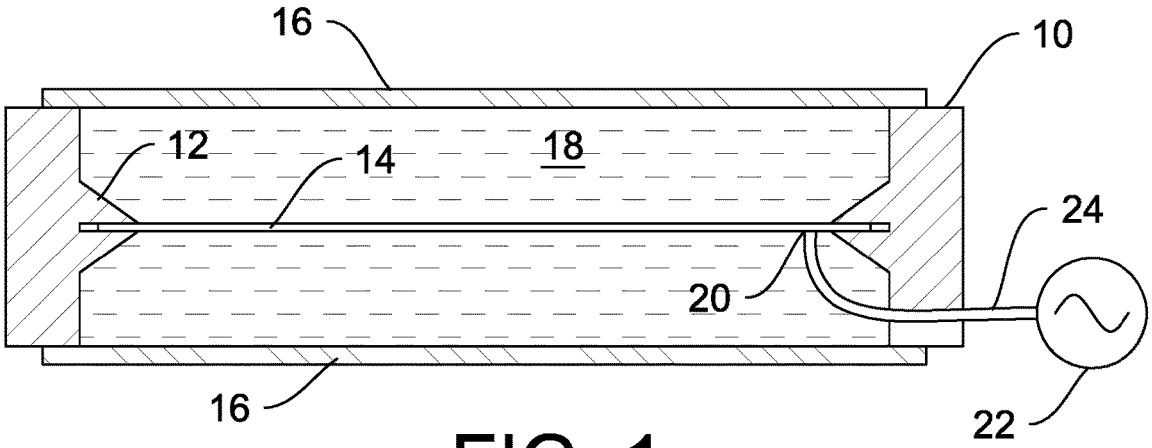
FIG. 1 is a cross-sectional view of a first embodiment of the thermoacoustic device.

A side view of one embodiment of the proposed device is shown in FIG. 1. This includes a housing 10 having a support means 12 for a thermoacoustic active element 14. Housing 10 is a rigid structure such as a cylinder having open ends. Support means can be any suitable fastening means known in the art including a compression device or an adhesive. Element 14 is positioned intermediately within housing 10. Open ends of housing 10 are sealed by acoustically transparent membranes 16 forming an encapsulation structure defining an interior volume. Housing 10 and membrane 16 assembly environmentally separates the interior volume from the environment. The interior volume is filled with a liquid 18. Liquid 18 is preferably a non-electrically conductive, polar liquid with a higher viscosity than that of water. Liquid 18 should also be a close match to the density and sound speed product of the surrounding environment. Glycerol has provided superior performance in testing.

Thermoacoustic active element 14 has electrodes 20 positioned on element 14 in such a manner as to cause element 14 to heat when subjected to a voltage difference. Electrodes 20 can consist of two conductive electrodes formed on or etched from a substrate material, multiple interdigitated electrodes, plated structures or the like. Electrodes 20 are electrically joined to a signal source 22 via a signal lead 24. Signal source 22 can be an alternating signal source such as an oscillator.

The thermoacoustic active element 14 may consist of one or multiple carbon nanotube (CNT) sheets. These are thin conductive networks or sponges consisting of carbon nanotubes, graphene, or carbon materials formed by pyrolysis (or a combination of such materials). These can be single wall nanotube sheets or multiwall nanotube sheets. Alignment of nanotubes within the sheet is not critical. CNT sheets are roughly 20 microns thick in air and can be between 50 nm-10 microns thick when submerged in a liquid. CNT sheets are preferred over other materials because they are very thin, porous networks, and have a low heat capacity. This makes thermoacoustic active element 14 responsive to rapid heating.

The encapsulation structure can be any structure which isolates the interior active element from the exterior aqueous environment. The encapsulation structure can be rigid or flexible, but contains at least one fill fluid. The fill fluid should be electrically non-conducting to prevent shorting the active element.

The thermoacoustic device operates by applying an alternating current through the active element. The desired input signal can be tailored using a number of available signal processing techniques (such as DC biasing, AC modulation, pulse width modulation, etc.). The current traveling through the electrodes causes heating in the region of the active element between the electrodes via resistive Joule heating. This results in a nonlinear acoustic output signal that is proportional to the square of the driving current. Pure sinusoids can be excited by applying an alternating current at half the desired output frequency. (Any voltage, positive or negative, causes current flow and generates heat. The element cools in the absence of a voltage across the electrodes.) This heat causes a temperature modulation on the surface of the active element which, in turn, transfers heat to the immediately surrounding environment. If the immediately surrounding environment includes a gas, the gas will undergo rarefaction and compression dictated by the ideal gas law, $PV=nRT$. The pressure wave that is generated then interacts with the next medium, glycerol in this case, and is transferred, in part or in whole, to this second medium. Sound propagation continues through the encapsulation media obeying the usually understood laws of physics.

One of the key features necessary for thermoacoustic excitation in submerged environments is that the active element is surrounded by a thin gas layer. As such, the thermoacoustic active element should have a rough or porous surface on a microscopic scale that would act to preserve the solid-gas interface. Super-hydrophobic surfaces lose their gaseous layer when submerged in water at even modest depths (~4.5 feet). An encapsulated device filled with glycerol proved to retain a high acoustic source level at a depth of 15 feet. Results suggest that the porous air filled microstructure of the CNT sheet are less susceptible to penetration by the more viscous, yet still polar, glycerol fill fluid than deionized water.

Some part of the liquid fill fluid is expected to be in direct contact with the active element. This fluid will also have heat transferred and undergo pressure changes due to thermal expansion/contraction of the fluid; however, the temperature change in the fluid will be far less than that of a gas as liquids have much higher heat capacities than gases. Therefore, minimizing the surface area contact between the active element and filling fluid is crucial to obtaining high device source levels.

Figure 2A:
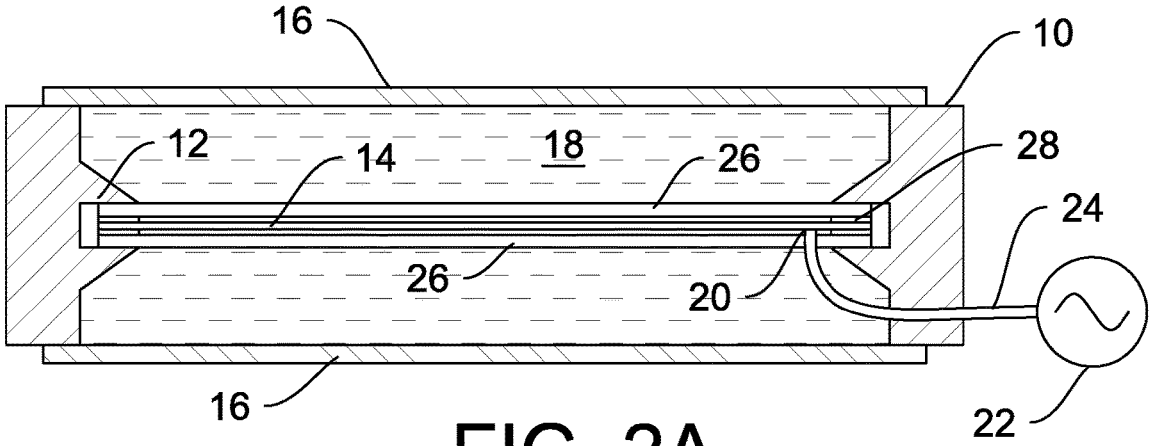
FIG. 2A is a cross-sectional view of a second embodiment of the thermoacoustic device.
Figure 2B:
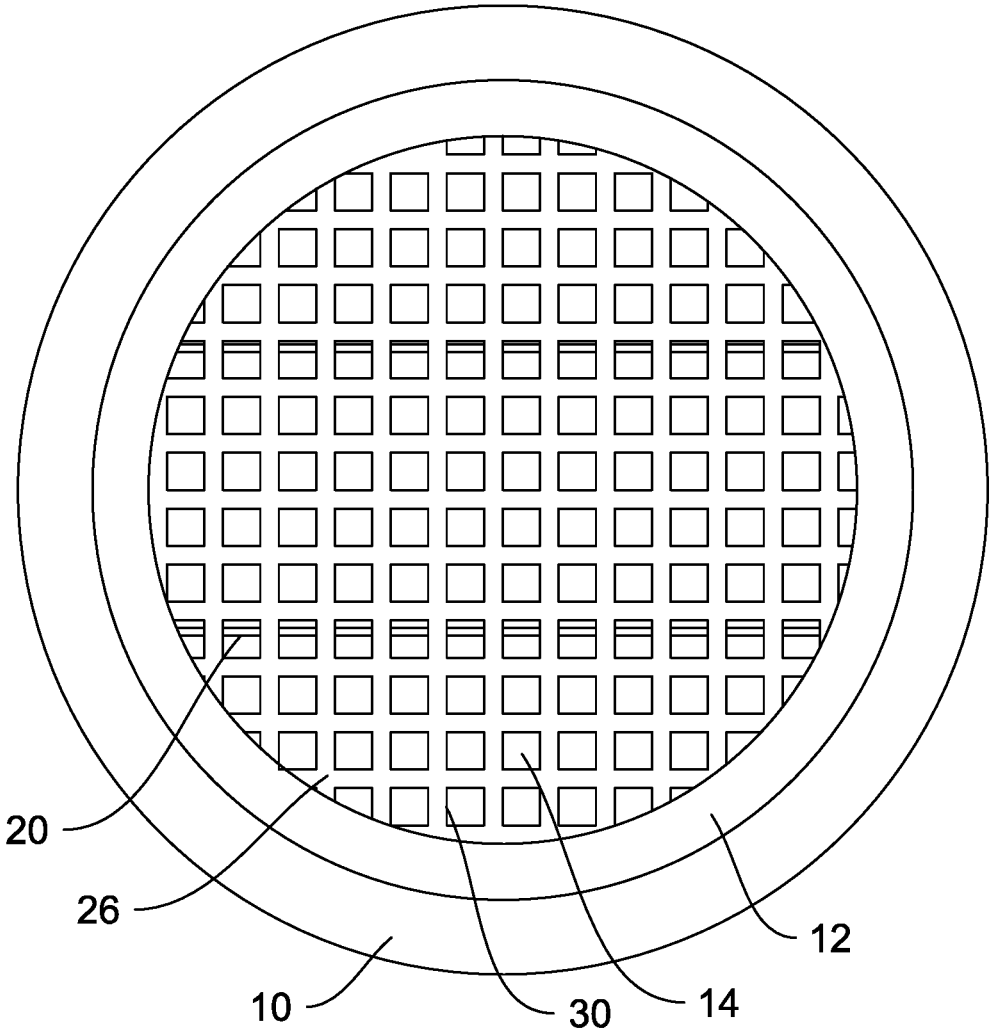
FIG. 2B is a top-view of the second embodiment with a portion removed.

In addition to the encapsulation structure, reinforcing the mechanical robustness of the thermophone active element is desirable. This is shown in FIG. 2A. In this embodiment, mesh sheets 26 are positioned on either side of active element 14. Mesh sheets 26 can be laid directly across the thermoacoustic active element 14; however, this reduces efficiency by providing a heat transfer path and additional thermal mass. In FIG. 2A, spacers 28 are positioned between mesh sheets 26 and active element 14. The combination is then affixed by support means 12 within housing 10. FIG. 2B shows a top view of this embodiment without membrane 16. Mesh sheets 26 are preferably porous to gases but not to the fill liquid within the encapsulation structure. It is also desirable to minimize heat transfer to the mesh sheets 26 and to maximize the acoustic energy transferred from the active element to the entrained gas. FIG. 2B shows square pores 30 in a square matrix with the active element 14 shown behind the pores, but pores 30 can be any shape and be arranged in any manner. Mesh sheet 26 can also be constructed as a screen having pores 30 defined as gaps between fibers or wires. Thus, the objective is to optimize the pore 30 size between the weaves and reduce the contact between the CNT sheet and substrate while still maintaining enough adhesion to provide the mechanical robustness necessary. Excess contact between the CNT sheet and substrate creates thermal leakage and reduces efficiency.

While the mesh 26 solely serves as a substrate in air, a hydrophobic or super-hydrophobic mesh 26 could be utilized in a liquid to help maintain a thin layer of gas around the active element 14, known as a plastron. The porosity of the mesh 26 allows a more direct interaction between the gas and surrounding liquid (water, glycerol, ethylene glycol, cornstarch/water slurry or mixtures and solutions of these, for example) enhancing heat dissipation and mitigating the resonances which result from using solid membranes.

The liquid 18 within enclosure 10 could be a polar liquid such as water or glycerol or a non-polar liquid such as oil. With a polar liquid, a hydrophobic or super-hydrophobic mesh 26 can be used. In testing, a glycerol fill liquid was used with a copper wire mesh having a super-hydrophobic coating. The coating used was a mixture of octodecylamine (Silguard 182™) and PDMS (Polydimethylsiloxane). The coating should electrically insulate the mesh in cases when a conductive mesh is used. Pore size in the tested embodiment was around 140 microns. It is believed that this could vary between 10 nm and 150 microns. Optimum pore size depends on the viscosity and the pressure of liquid 18.

When liquid 18 is oil, a hydrophilic or super-hydrophilic material (ones that attract water) can be used because these materials are inherently oleophobic or super-oleophobic (ones that repel oil). It is speculated that this super-hydrophilic/super-oleophobic material mesh could also be used to maintain an air gap if the liquid immediately surrounding the mesh were nonpolar/polar, respectively. This could remove some of the fill fluid restrictions for encapsulated devices because oils are typically better electrical insulators. Studies have yet to be conducted using such mesh devices at depth and they may suffer from a similar collapse of the gas layer.

The primary advantage that glycerol provides as a fill fluid for thermoacoustic devices is that it allows the retention of gas immediately surrounding and within the active element. While deionized water is also capable of retaining a gas layer, the layer is more subject to collapsing under the high pressures associated with submerging the thermoacoustic device (>4.5 ft.). This is likely due to a combination of properties which make glycerol an attractive fluid fill material for thermoacoustic devices. Aside from water, glycerol has one of the highest liquid surface tensions. Although the surface tension on glycerol is slightly less than that of water (~13% lower at 20 C), the difference becomes less apparent at higher temperatures (~4.4% lower at 90° C.). The solubility of common gases in glycerol is much lower than in water (<⅓ for $N_2$ and <½ for $CO_2$), which helps to decrease the dissolution rate as well. The viscosity of glycerol is higher than that of water, and pure glycerol has a freezing point near 15° C. (59° F.). As such, pure glycerol could possibly solidify at depth and freeze the plastron boundary in place, which would subsequently reliquify upon heating during use. If, instead, the dimensional change of glycerol upon freezing were to cause damage to the sheet, using a glycerol/water mixture greatly lowers the freezing point to as low as −46° C. at 66.7%/33.3% by weight. Glycerol/water mixtures also have an increased boiling point (up to 290° C. for pure glycerol) which extends the working power range for these thermophones. Glycerol also has a 40% increased thermal diffusivity over water, allowing it to respond faster to thermal fluctuations.

Additionally, tests have shown that electrolysis (splitting water molecules into hydrogen and oxygen gas) does occur at the active element surface even when alternating currents are utilized. Glycerol is not subject to electrolysis, and therefore at lower risk of burning the active element in localized regions at higher temperatures. Electrolysis has been used, however, as a means of regenerating plastron, which could be desirable at depth.

Figure 3:
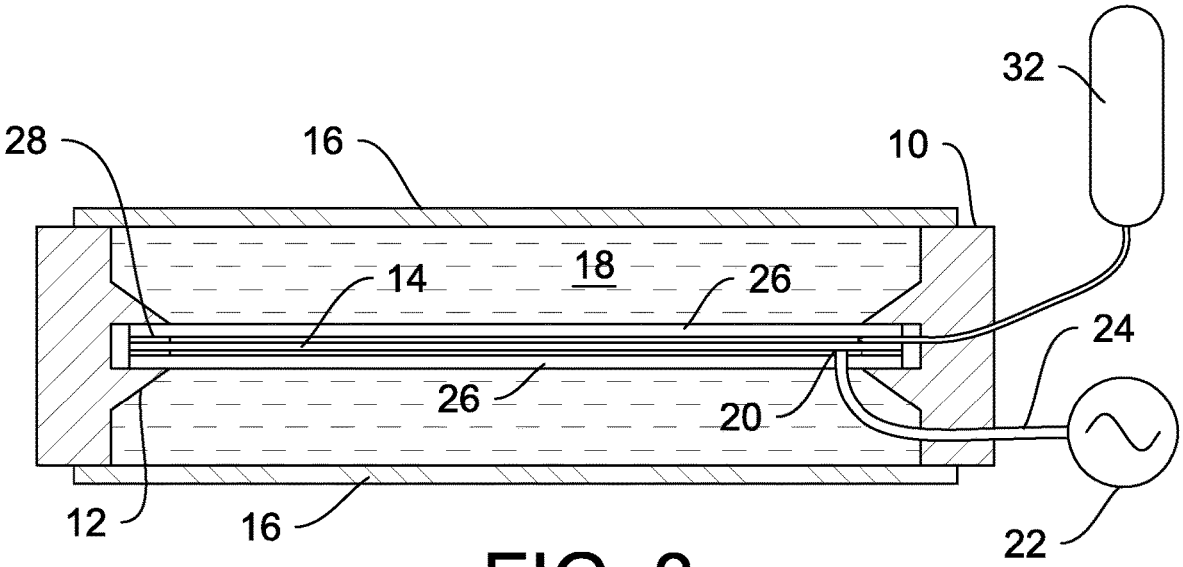
FIG. 3 is a cross-sectional view of a third embodiment of the thermoacoustic device.

FIG. 3 shows an alternate embodiment in which a gas reservoir 32 is joined in communication with active element 14 through housing 10. Reservoir 32 should be pressure balanced with the surrounding environment. As the gas in the mesh 26 collapses under pressure, gas in reservoir 32 would be pulled into contact with mesh 26, filling the gap. The advantage of such a system would be the ability to retain the non-resonant 'open' response, unlike in gas filled encapsulated devices, while simultaneously allowing capability at greater depth. Additionally, as mentioned, utilizing a sandwiched mesh structure allows for a wider array of fill fluids as the properties of the mesh can be tuned to repel the fill fluid rather than burdening the active element itself with that requirement.

A sandwiched mesh structure can allow retention of a thicker gas layer than some thermoacoustic active elements alone. Additionally, by tuning the properties of the mesh, the sandwiched structure could allow a broader range of fill fluids to be utilized. Alternate fill fluids could lead to improvements in device performance based on their thermal conductivity, speed of sound, compatibility with other components or the environment, etc.

Figure 4:
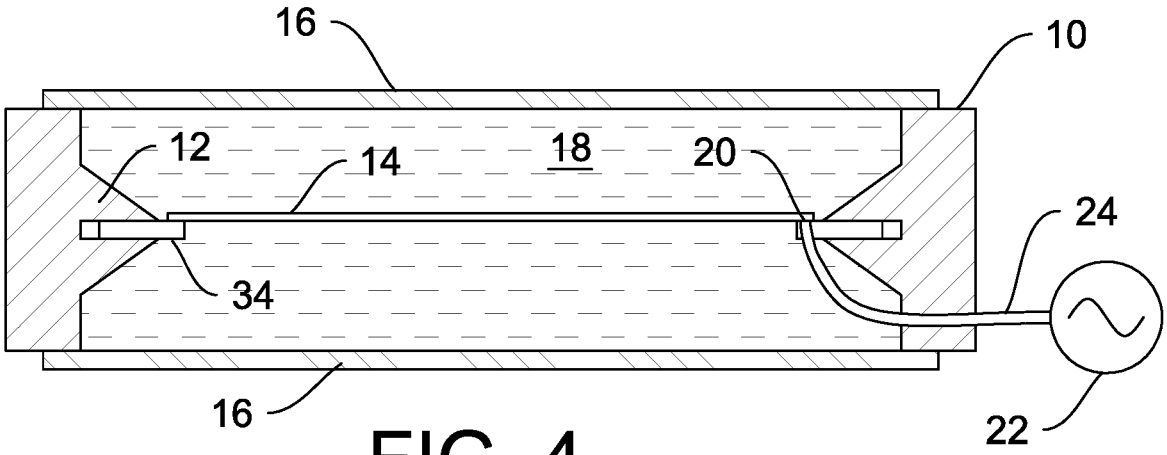
FIG. 4 is a cross-sectional view of a fourth embodiment of the thermoacoustic device.

In FIG. 4, there is shown a thermoacoustic device with an alternate mounting structure between active element 14 and housing 10. Active element 14 and electrodes 20 are affixed to a substrate 34. Substrate 34 is retained by support means 12. This can be by positioning substrate 34 in a slot formed in support means 12 by clamping, or by other means known in the art.

The foregoing description of the preferred embodiments of the invention has been presented for purposes of illustration and description only. It is not intended to be exhaustive, nor to limit the invention to the precise form disclosed; and obviously, many modification and variations are possible in light of the above teaching. Such modifications and variations that may be apparent to a person skilled in the art are intended to be included within the scope of this invention as defined by the accompanying claims.

What is claimed is:

1. A thermoacoustic device comprising:
a housing having at least one open face;
an active element supported within said housing;
at least two electrodes in electrical contact with said active element;
at least, one membrane joined to said housing open face and defining a housing volume in combination with said housing;
a liquid positioned in said housing volume; and
a signal lead joined between said at least two electrodes in the housing volume and an exterior of said housing and said at least one membrane.

2. The apparatus of claim 1, wherein Said active element is made from a carbon nanotube sheet.

3. The apparatus of claim 1, further comprising a gas in contact with said active element at a surface thereof, said active element surface being repellant to said liquid positioned in said housing volume.

4. The apparatus of claim 3, wherein said liquid is glycerol.

5. The apparatus of claim 3, wherein said liquid is oil.

6. The apparatus of claim 1, further comprising a mesh joined to said housing on at least one side of said active element for preventing excessive deflection of said active element.

7. The apparatus of claim 6, further comprising a gas in contact with said active element at a surface thereof wherein said mesh is designed to maintain said gas around said active element.

8. The apparatus of claim 7, wherein said mesh is made from a hydrophobic material.

9. The apparatus of claim 7, wherein said mesh is made from a hydrophillic material.

10. The apparatus of claim 7, further comprising a gas source in communication with the housing volume proximate said active element.

11. The apparatus of claim 7 wherein said gas has a low solubility in said liquid.

12. The apparatus of claim 1, further comprising first and second meshes joined to said housing on either side of said active element for preventing excessive deflection of said active element.

13. The apparatus of claim 12, further comprising a gas in contact with said active element at a surface thereof wherein said first and second meshes are designed to maintain said gas around said active element.

14. The apparatus of claim 13, wherein said first and second meshes are made from a hydrophobic material.

15. The apparatus of claim 13, wherein said liquid is oil.

16. The apparatus of claim 15, wherein said first and second meshes are made from a hydrophillic material.

17. The apparatus of claim 13, further comprising a gas source in communication with the housing volume proximate said active element.

18. The apparatus of claim 13 wherein said gas has a low solubility in said liquid.

19. The apparatus of claim 1, further comprising a substrate positionable in said housing and made from a rigid material, said active material and said electrodes being mounted on said substrate whereby said substrate acts to support said active element in said housing.

20. The apparatus of claim 1 wherein said at least one membrane is acoustically transparent.

* * * * *